United States Patent [19]

Köbel et al.

[11] Patent Number: 4,538,664

[45] Date of Patent: Sep. 3, 1985

[54] PROCESS AND APPARATUS FOR COMPACTING MOLD MATERIAL

[75] Inventors: Alfons Köbel, Karlsruhe; Norbert Damm, Karlsdorf-Neuthard, both of Fed. Rep. of Germany

[73] Assignee: BMD Badische Maschinenfabrik Durlach GmbH, Karlsruhe, Fed. Rep. of Germany

[21] Appl. No.: 475,725

[22] Filed: Mar. 16, 1983

[30] Foreign Application Priority Data

Mar. 23, 1982 [DE] Fed. Rep. of Germany ..... 3210504

[51] Int. Cl.[3] ..... B22C 15/00

[52] U.S. Cl. ..... 164/37; 164/169

[58] Field of Search ..... 164/37, 38, 169, 195, 164/12, 19

[56] References Cited

U.S. PATENT DOCUMENTS 3,659,642 5/1972 Vasilkovsky et al. ..... 164/169

FOREIGN PATENT DOCUMENTS 2949340 6/1980 Fed. Rep. of Germany .

38222 3/1979 Japan ..... 164/169

22848 2/1982 Japan ..... 164/37

*Primary Examiner*—Nicholas P. Godici

*Assistant Examiner*—J. Reed Batten, Jr.

*Attorney, Agent, or Firm*—Antonelli, Terry & Wands

[57] ABSTRACT

In a process for compacting foundry mold making material, and more specially wet foundry sand, by the violent effect of gas pressure on the free surface of the mold material heaped on to the pattern, the compacting effect may be made better and the height of extra material on the pattern may be better controlled by placing a gas-permeable further or auxiliary mass on the free surface of the mold material. The further material is made up of separate pieces of material that may be moved in relation to the surface of the mold material, the gas pressure taking effect on the free surface of the further mass. The further mass may be used in compaction processes in which the pressure wave is produced by expansion of gas from a receiver and processes in which the wave is produced by an explosion.

8 Claims, 1 Drawing Figure

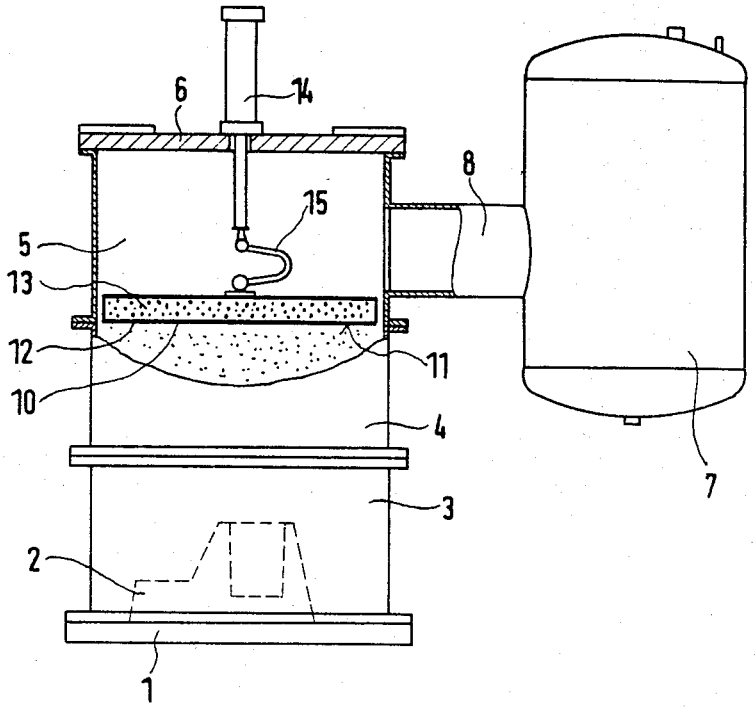
6
14
8
15
5
13
12
11
10
4
7
3
2
1

PROCESS AND APPARATUS FOR COMPACTING MOLD MATERIAL

BACKGROUND OF THE INVENTION

The present invention is with respect to a process and an apparatus for compacting foundry mold-making materials, and more specially for compacting wet foundry sand, by the impacting effect of a gas pressure wave on the molding material heaped onto a pattern.

A number of different forms of process on these lines have been put forward in the past and this sort of process is in fact presently becoming increasingly economically important. Examples of the process are to be seen in the German Auslegeschrift specification 1,961,234 and the German Offenlegungsschrift specification 2,949,340. The main way in which such processes are different from each other is with respect to the way of producing the pressure wave. In the one case a highly compressed gas is kept in an inlet space or antechamber and suddenly decompressed (see the said specification 1,961,234) or in the other case the gas pressure is produced right over the mold space by the explosion of a flammable gas mixture. In addition to these two families of processes there are a number of different further forms, which are however of little interest here inasfar as they have little in common with the present invention. In all the forms of the said process the pressure wave produced makes its way towards the surface of the mold material and is then responsible for a compacting effect on the said material.

Although workers in the field do not so far have any complete picture of the cause and effect of this form of compacting operation, it is known that the compaction is caused by fluidizing effects on the one hand and the impact pressure on the other, that takes effect at the particle level in the mold making material. Because of the fluidizing effect there is a decrease in the surface forces between one particle and the next of mold material and between the particles and the pattern or the flask and the filling frame so that the forces of momentum produced on the separate particles of mold making material by the effect of the gas or the particles next thereto are responsible for a more compact packing together of the mold making material.

A further observation made has been that the degree of compaction is dependent not only of the parameters (pressure and speed) of the gas pressure wave but furthermore on the level or height of the heaped molding material. There is in fact a lower limit for the cover of molding material, under which no degree of compaction with the desired effects may be produced. On the other hand there is an upper limit for the covering of mold material, above which there is not enough compaction, more specially in the case of the back of the mold. The operation is for this reason mostly undertaken with an excess of mold making material, that in the first-noted case is responsible for an unnecessarily high mold, while in the second case there will be an unnecessary extra part of molding material that has to be taken off after compaction.

SUMMARY OF THE INVENTION

One purpose of the present invention is that of designing a process and an apparatus, with whose help it is possible to make certain of an even compaction effect over the full height of the mold while cutting down the amount of mold making material needed as far as possible.

For effecting this and further purposes in the invention a gas-permeable further or auxiliary mass is placed on the surface of the mold making material and the gas pressure is caused to take effect on the free surface of the said further mass.

It has been seen from tests undertaken under true working conditions using such a further mass that after perfecting or optimizing the process it is possible to have an even degree of compaction not only over the cross section of the mold but furthermore of the height of the mold, it being possible for the covering of molding material to be limited over the outline to the degree needed to make the mold resistant enough to transport and teeming effects thereon. When the compaction operation is taking place the further mass may be pervaded by the gas pressure wave, given a moderate resistance to flow, and the flow is able to make its way into the heaped up mold making material. In fact, the fluidizing effect is not decreased by the said further mass. The dynamic pressure head, that is in fact responsible for causing the compaction as such, takes effect not only on the particles of mold making material but furthermore on the parts of the further mass that let through the gas, the said further mass transmitting the momentum effects transmitted thereto to the particles of mold making material.

The important point here is that the further or auxiliary mass is only rested on (and not forcefully thrown onto) the free surface of the mold making material, because any such throwing effect would be responsible for an undesired and premature compaction on the back of the mold. It is in fact in this respect that the invention is different to other, past suggestions in which a covering was to be placed on the surface of the mold making material. Such a covering (see the U.S. Pat. No. 2,830,339), even if made of elastic material, does in fact have the effect of a compacting piston without there being any chance of the compacting gas making its way into and pervading the heaped mold material. The same is true with another earlier suggestion (see German Offenlegungsschrift specification 2,949,340) in which, using explosion compaction, the surface of the mold making material was to be completely or partly covered with a gas-tight covering, with the purpose of stopping the back of the mold crumbling away or of causing less compaction at parts which were not covered over.

With the process of the present invention it has turned out that after the compacting effect has been produced, the surface of the mold material is more or less even all over, something which has not so far been possible with known methods. Because the mass of the mold material is in the very best condition, the extra height of the mold material needed may be better controlled, and more specially it may be kept to a low level. For a given size of mold and filling of mold material and furthermore a given degree of compaction it is possible to make do with a lower gas energy and/or gas volume than in known methods by using an auxiliary mass, according to the invention so that there is, more specially, a decrease in the amount of gas needed. Furthermore the process of the invention may be undertaken whatever the direction of compaction of the mold material, that is to say downwards or upwards.

In keeping with a preferred further development of the invention in which the further or auxiliary mass is made up of single separate masses able to be moved in a direction that is normal to the surface of the mold material, it is possible to make certain that each single piece of mass is able to be moved by the momentum given to it by the pressure wave and to give up such energy to the particles of mold material.

As part of a further useful outgrowth of the invention the further mass has such a distribution of the separate masses in keeping with the outline of the pattern that there is less mass over the higher up parts of the pattern than over the lower parts thereof.

As part of a preferred form of the invention the further mass is made up of particles with a greater specific gravity than the mold making material and of a gas-permeable flexible casing shutting in the particles. The resistance to flow of this further mass and for this reason the pushing force produced thereby may be changed by the form of the particles and their bulk density so that it is not only the size of the further mass but furthermore the said parameters named hereinbefore that make possible control of the desired effects.

For undertaking the said process the invention takes as a starting point, apparatuswise, a system with a mold box or flask that is shut off on one side by a pattern plate, a filling frame forming a further part of the flask and a unit for producing or storing gas at a high pressure, that is caused to take effect violently on the mold material in the filling frame.

In keeping with the invention such an apparatus is characterized in that the gas-permeable further mass may be placed on the free surface of the mold material, covering more or less all thereof, and such mass may be lifted clear of the mold material after compaction.

It will be seen from this that the further mass is placed in each working cycle of the apparatus (that may for example be a mold making machine) on the mold material placed in the mold space, then the gas pressure wave is caused to take effect and after letting off gas from the mold space the further mass is moved clear of the compacted mold again.

In the simplest case the further or auxiliary mass may be in the form of a perforated plate, although however in keeping with a preferred form of the apparatus and said mass is in the form of a cushion partly covering the surface of the mold material, the cushion being made up of heaped metal particles and a fabric casing therefor. The metal particles may for example be granules, shot or the like while the fabric casing is made of man-made fibers or synthetic resin, or, if an explosive force is used for compacting so that there is a heating effect, of wire.

The further mass made up on these lines is supported, for example so as to be dependent, so that it may be moved freely at least to some degree and on the one hand may be put in position and taken off again while on the other hand it may readily be moved by the forces acting thereon.

BRIEF DESCRIPTION OF THE DRAWINGS

The single drawing FIGURE is a lengthways section through one example of the apparatus of the invention.

DETAILED DESCRIPTION OF PREFERRED EMBODIMENTS

The account is to be read in connection with the FIGURE that is a lengthways section through one example of the apparatus of the invention.

In the FIGURE the reader will see a pattern plate 1 with a pattern 2 forming the lower wall of a flask 3. On the flask 3 there is a filling frame 4 stretching upwards as a gas header or plenum space 5. Within the mold space in the limited sense of the wording there is a shut-off plate 6 as a fixed or permanent part of a machine frame, against which the parts of the apparatus walling in the mold space are forced in the compaction operation. The rest of the apparatus as needed for handling the flask 3, the filling frame 4 and the header space 5, and furthermore parts for filling the flask may be of known design and have not been made part of the FIGURE so as to make it more straightforward.

In the present example of the invention a vessel 7 is joined up by a pipe 8 with the gas header space 5. The vessel 7 may be in the form of a receiver for compressed gas or a gas pressure may be produced therein by causing an explosion of a flammable gas mixture. If desired there may be a valve in the connection pipe 8 for letting through the gas as a pressure wave into the gas header space 5.

A further part of the apparatus is the further or auxiliary mass 10 that is placed on the free surface 11 of the mold making material within the filling frame 4 before the compaction operation. This further mass 10 is made up on the one hand of an outer casing 12 in the form of a perforated sheet or of fabric for example, and on the other hand of a filling 13 therein. The filling may be made up of particles with a high specific gravity as for example metal granules or metal shot or the like.

In the present working example the further mass 10 is joined by a lifting rope 15 with a lifting unit 14, by way of which it may be lowered onto the surface or top face of the mold material and then later lifted upwards therefrom. Because the further mass 10 is handled by way of the rope 15 it may be moved in a direction normal to the face of the mold material when the compaction motion takes place. However in place of such a hanging support the further mass may be joined with the lifting unit 14 by way of a catch locking into a locking part on the further mass for the purpose of lifting it clear of the mold when completed. For putting the further or auxiliary mass on the mold material the catch then only has to be undone, the mass then falling freely onto the filling of mold material.

We claim:

1. A process for compacting foundry mold making material by gas pressure compaction comprising heaping foundry mold making material onto a pattern, placing a further, gas-permeable mass all over a top, otherwise free surface of said material, said further, gas-permeable mass being made up of a number of separate masses able to be moved in a direction normal to the said top surface of the material, causing a gas pressure to take effect on the said surface to compact said mold making material and removing said further, gas-permeable mass from said compacted mold making material.

2. The process as claimed in claim 1 wherein said separate masses have such a distribution as to be in keeping with the outline of the pattern when placed on said surface, the said mass being smaller over high parts of the pattern than over low parts thereof.

3. The process as claimed in claim 1 wherein said further mass is made up of particles with a higher specific gravity than the mold making material and of a gas-permeable flexible casing around the said particles.

4. An apparatus for the compaction of a mold, comprising a flask, a pattern plate walling in one side of said flask, a filling frame walling in a space joined with a space within said flask, a high gas pressure means for supplying of gas under a high pressure to mold material in said filling frame for producing a violent compacting effect thereon, and a further mass designed to be placed on an otherwise free upper surface of said mold material for completely covering same, said further mass being gas-permeable and made up of a number of separate masses able to be moved in a direction normal to the said upper surface of the mold material, and said further mass being able to be lifted clear of said mold material after compaction thereof.

5. The apparatus as claimed in claim 4 wherein said further mass is made at least partly of a cushion for at least partly covering over the said surface of the mold material, said cushion being made up of a casing of fabric and metal particles within same as said number of separate masses.

6. The apparatus as claimed in claim 4 further comprising means for placing said further mass on said mold material and for lifting it from said mold material after compaction.

7. The apparatus as claimed in claim 5 further comprising means for supporting said further mass so that it may be moved to a limited degree.

8. The apparatus as claimed in claim 7 wherein a rope comprises the means for supporting said further mass.

* * * * *